US007987942B2

(12) United States Patent
Lee

(10) Patent No.: US 7,987,942 B2
(45) Date of Patent: Aug. 2, 2011

(54) UPPER FRAME FOR EXCAVATOR

(75) Inventor: Jin Woo Lee, Kimhae (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 133 days.

(21) Appl. No.: 12/217,166

(22) Filed: Jul. 2, 2008

(65) Prior Publication Data

US 2009/0007463 A1 Jan. 8, 2009

(30) Foreign Application Priority Data

Jul. 4, 2007 (KR) ..... 10-2007-0067106

(51) Int. Cl.
*B62D 21/06* (2006.01)

(52) U.S. Cl. ..... 180/312; 280/781; 37/397

(58) Field of Classification Search ..... 180/89.1, 180/89.13, 311, 312; 280/781, 793, 794, 280/795; 37/397
See application file for complete search history.

(56) References Cited

U.S. PATENT DOCUMENTS

| | | | | |
|---|---|---|---|---|
| 5,894,908 | A * | 4/1999 | Eftefield | 280/781 |
| 6,499,556 | B1 * | 12/2002 | Koyama | 180/311 |
| 6,922,925 | B2 * | 8/2005 | Watanabe et al. | 37/466 |
| 7,500,532 | B2 * | 3/2009 | Koga et al. | 180/89.13 |
| 2003/0110669 | A1 | 6/2003 | Watanabe et al. | |
| 2006/0108171 | A1 * | 5/2006 | Koga et al. | 180/327 |

FOREIGN PATENT DOCUMENTS

| | | |
|---|---|---|
| EP | 1 754 835 | 2/2007 |
| JP | 2003-213727 | 7/2003 |
| JP | 2005-1480 | 1/2005 |
| JP | 2005-83040 | 3/2005 |
| JP | 2006-274598 | 10/2006 |

* cited by examiner

*Primary Examiner* — Paul N Dickson
*Assistant Examiner* — Joseph Rocca
(74) *Attorney, Agent, or Firm* — Ladas & Parry LLP

(57) ABSTRACT

An upper frame for an excavator is provided to smoothly transmit the load and shock which is transmitted through a mounting portion of a working device during operation (e.g., a lifting operation mode), to an upper frame by integrally installing a bracket for mounting a fuel tank or the like on an upper plate of the upper frame. The upper frame includes a center frame having a bottom plate and a pair of side plates and vertically welded to the bottom plate, a left side frame welded to the side plate of the center frame, a right side frame welded to the side plate of the center frame, an upper plate placed in the front of the center frame for supporting a bracket for a working device, to which a boom is pivotally secured, and an extended member integrally extended from one end of the upper plate for supporting desired parts.

3 Claims, 5 Drawing Sheets

UPPER FRAME FOR EXCAVATOR

CROSS-REFERENCE TO RELATED APPLICATION

This application is based on and claims priority from Korean Patent Application No. 10-2007-0067106, filed on Jul. 4, 2007 in the Korean Intellectual Property Office, the disclosure of which is incorporated herein in its entirety by reference.

BACKGROUND OF THE INVENTION

1. Field of the Invention

The present invention relates to an upper frame for an excavator which can smoothly transmit the load and shock which is transmitted through a mounting portion of a working device during operation (e.g., a lifting operation mode), to an upper frame by integrally installing a bracket for mounting a fuel tank or the like on an upper plate of the upper frame.

More particularly, the present invention relates to an upper frame for an excavator which can minimize stress concentration due to the load and shock, which is transmitted to an upper frame through a mounting portion of a working device during operation, by integrally extending a bracket for mounting a fuel tank or the like from an upper plate of the upper frame, thereby preventing durability of a welding structure from being deteriorated.

2. Description of the Prior Art

Referring to FIG. 1, a conventional tracked excavator includes a lower driving structure 1, an upper frame 2 swiveled on the lower driving structure 1, an engine room 4 mounted on the upper frame 2 in the rear of the cabin 3, a working device mounted on the upper frame 2 and having a boom 5 driven by a boom cylinder 8, an arm 6 driven by an arm cylinder 9 and a bucket 7 driven by a bucket cylinder 10, and a counter weight 12 mounted in the rear of the upper frame 2 for maintaining a balance of the equipment during operation.

Reference numerals 16 and 17 designate a fuel tank and a hydraulic tank placed in the front of the upper frame 2, respectively.

Referring to FIGS. 1 and 2, the upper frame of the conventional excavator includes a center frame 13 having a bottom plate 13*a* with a swing ring gear (not shown) mounted on a bottom surface, and a pair of side plates 13*b* and 13*c* vertically welded to the bottom plate 13*a* for supporting the working device comprising the boom 5, a right side frame 14 welded to an outer side of the side plate 13*c* of the center frame 13 for supporting the fuel tank 16 of the equipment or the like, and a left side frame 15 welded to an outer side of the side plate 13*b* of the center frame 13 for supporting the cabin 3 or the like.

In this instance, a vibration absorbing device (not shown) is mounted on the left side frame 15 to absorb or relief the shock or vibration transmitted to an interior of the cabin 3 from the lower driving structure 1.

As described above, after the center frame 13, the left side frame 15 and the right side frame 14 are separately manufactured, the left side frame 15 is welded to the side plate 13*b* of the center frame 13, and the right side frame 14 is welded to the side plate 13*c* of the center frame 13, thereby completing the upper frame 2.

As shown in FIG. 2, the bracket performing a desired function is mounted at a position adjacent to the welding structure (i.e., the upper plate, the side plate and the lower plate) of the upper frame in order to utilize a limited space in view of characteristics of the equipment.

A bracket 18 is secured to the side plate 13*c* of the center frame 13 in order to mount the fuel tank 16 and the hydraulic tank at desired positions of the upper frame 2. The bracket 18 is separately secured to the upper plate 19 in opposite to a pair of brackets 20, the working device (i.e., the boom) being pivotally mounted on the brackets 20.

With the above construction, when the shock and load generated during the operation is transmitted to the upper frame 2 through the working device, the shock or the load is not transmitted to the upper frame 2, as the bracket 18 is separated from the upper plate 19.

Also, since the bracket 18 is provided discontinuously from an end of the upper plate 19 (i.e., a gap is formed between the upper plate 19 and the bracket 18), the stress resulted from the shock and load is concentrated on the portion to cause the welded structure to damage or the durability of the upper frame to deteriorate, thereby shortening a lifespan of the equipment.

SUMMARY OF THE INVENTION

Accordingly, the present invention has been made to solve the above-mentioned problems occurring in the prior art while advantages achieved by the prior art are maintained intact.

One object of the present invention is to provide an upper frame for an excavator which can minimize stress concentration due to the load and shock, which is transmitted to an upper frame through a mounting portion of a working device during operation, by integrally extending a bracket for mounting a fuel tank or the like from an upper plate of the upper frame, thereby preventing durability of a welding structure from being deteriorated.

In order to accomplish these objects, there is provided an upper frame of an excavator, according to the present invention, which includes a center frame having a bottom plate and a pair of side plates vertically welded to the bottom plate; a left side frame welded to the side plate of the center frame; a right side frame welded to the side plate of the center frame; an upper plate placed in the front of the center frame for supporting a bracket for a working device, to which a boom is pivotally secured; and an extended member integrally extended from one end of the upper plate for supporting desired parts.

The extended member and the upper plate may be are provided in an integral member, or may be jointed to each other by welding.

Preferably, a welded joint portion formed between the extended member and the upper plate has an inclined angle of 50 to 80 degrees with respect to the side plate of the center frame.

In a welded joint portion between the upper plate and the extended member, if the upper plate has a thickness relatively greater than a thickness of the extended member, an inclined portion is formed on the welded joint portion towards the upper plate.

An outer surface of the welded joint portion between the upper plate and the extended member is flush with an outer surface of the upper plate and an outer surface of the extended member.

With the above construction, since the bracket for supporting a fuel tank is integrally provided on the upper plate of the upper frame, the shock and the load is smoothly transmitted from mount portion of a working device to the upper frame, thereby preventing the welded structure from being damaged due to the stress or deterioration of the durability of the welded structure.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 3:
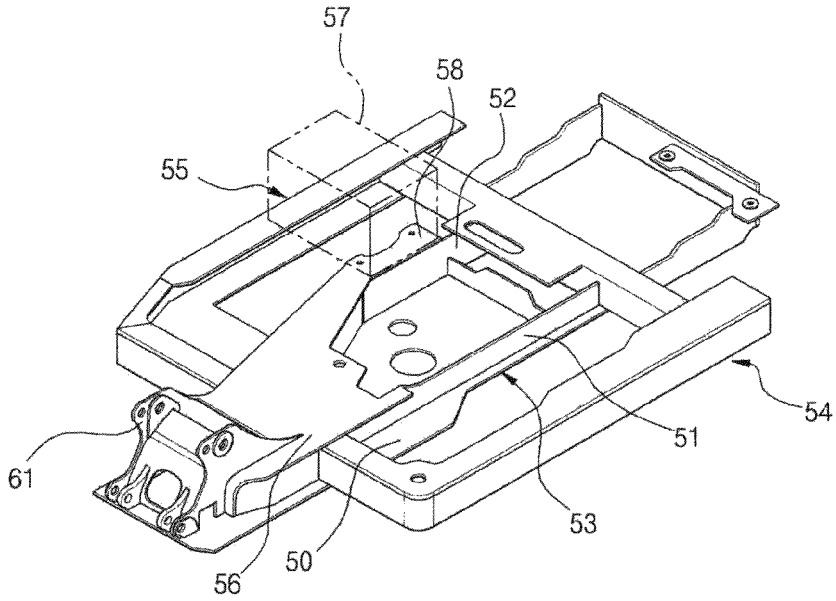
FIG. 3 is a perspective view illustrating an upper frame of a tracked excavator according to an embodiment of the present invention.
Figure 8:
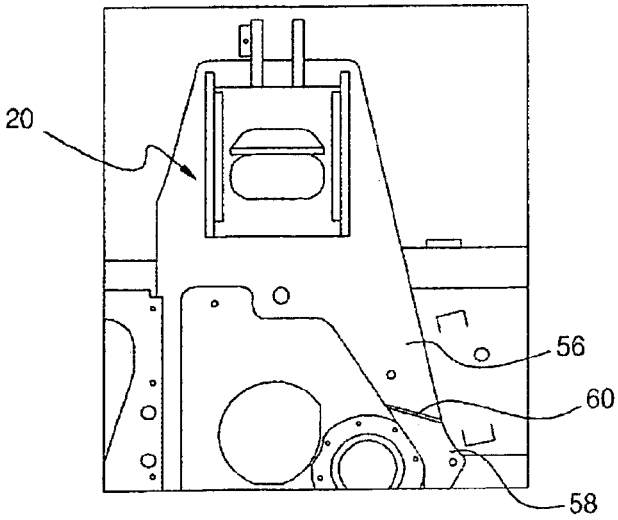
FIG. 8 is a plan view illustrating the welded joint portion in FIG. 4.

Referring to FIGS. 3 and 8, an upper frame of an excavator according to an embodiment of the present invention includes a center frame 53 having a bottom plate 50 with a swing ring gear (not shown) mounted on a bottom surface thereof, and a pair of side plates 51 and 52 vertically welded to the bottom plate 50, a left side frame 54 welded to an outer side of the side plate 51 of the center frame 53 for supporting a cabin (not shown), a right side frame 55 welded to an outer side of the side plate 52 of the center frame 53 for supporting a fuel tank 57 and a hydraulic tank (not shown), an upper plate 56 placed in the front of the center frame 53 for supporting a bracket 61 for a working device, to which a boom (not shown) is pivotally secured, and an extended member 58 integrally extended from one end of the upper plate 56 for supporting desired parts (for example, a fuel tank 57, a hydraulic tank or the like).

As shown in FIG. 3, as the extended member 58 and the upper plate 56 are provided in an integral member, it is possible to prevent the strength of the structure from being deteriorated due to the stress resulted from when the extended member and the upper plate are welded.

Referring to FIGS. 4 to 8, since the extended member 58 and the upper plate 56 are jointed to each other by welding, the manufacturing operation thereof is convenient thereby to improve the working efficiency.

Figure 6:
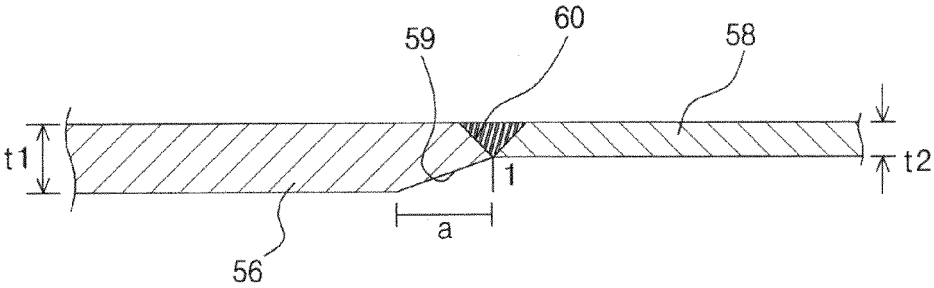
FIG. 6 is a partially cross-sectional view illustrating the welded joint portion for jointing an upper plate and an extended member in FIG. 4.
Figure 7:
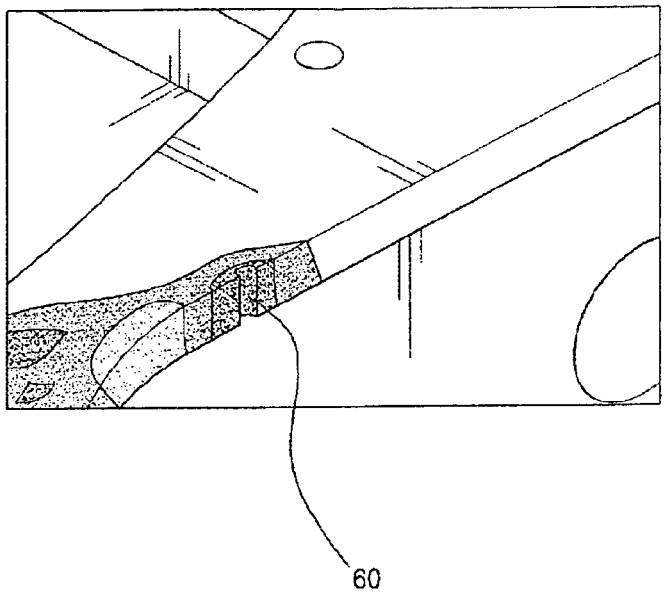
FIG. 7 is a photograph showing stress distribution at the welded joint portion sin FIG. 4.

Referring FIGS. 6 and 7, a welded joint portion 60 formed between the extended member 58 and the upper plate 56 has an inclined angle of 50 to 80 degrees with respect to the side plate 52 of the center frame 53. It is noted that a welded zone ($\theta 3$) of the welded joint portion 60 (e.g., $\theta 1$ is 50°, and $\theta 2$ is 80°) avoids a dangerous zone ($\theta 1$) on which the stress may be concentrated when a notch is formed by welding the extended member 58 and the upper plate 56. In other words, it means that low stress is concentrated on the welded zone ($\theta 3$) of the welded joint portion 60, as compared with the zone ($\theta 1$).

As shown in FIG. 6, in the welded joint portion 60 between the upper plate 56 and the extended member 58, if the upper plate 56 has a thickness ($t1$) relatively greater than a thickness ($t2$) of the extended member 58 ($t1>t2$), an inclined portion 59 is formed on the welded joint portion 60 towards the upper plate 56 (in this instance, $a>1$).

Figure 4:
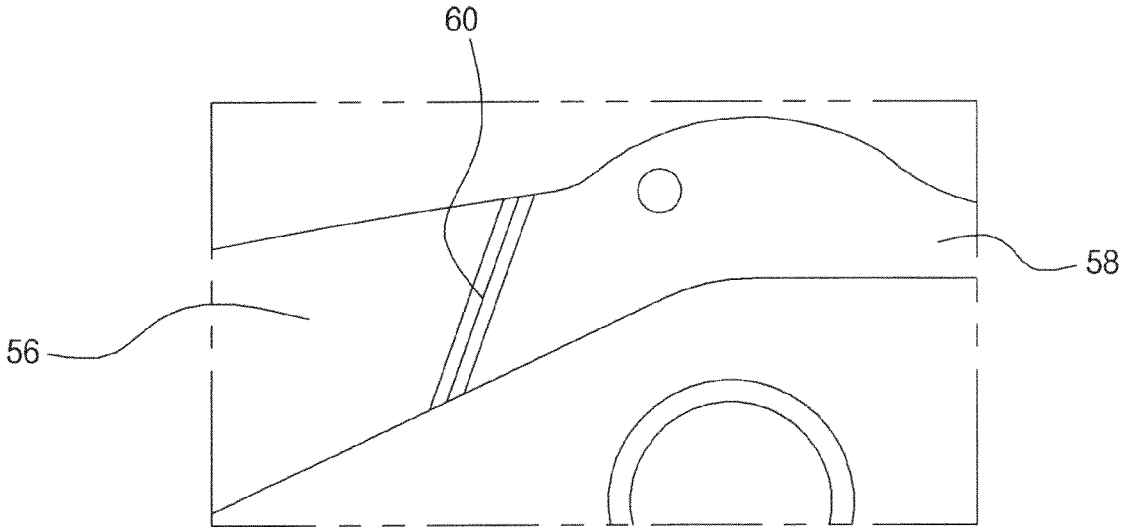
FIG. 4 is a view illustrating an upper frame of an excavator according to another embodiment of the present invention.
Figure 5:
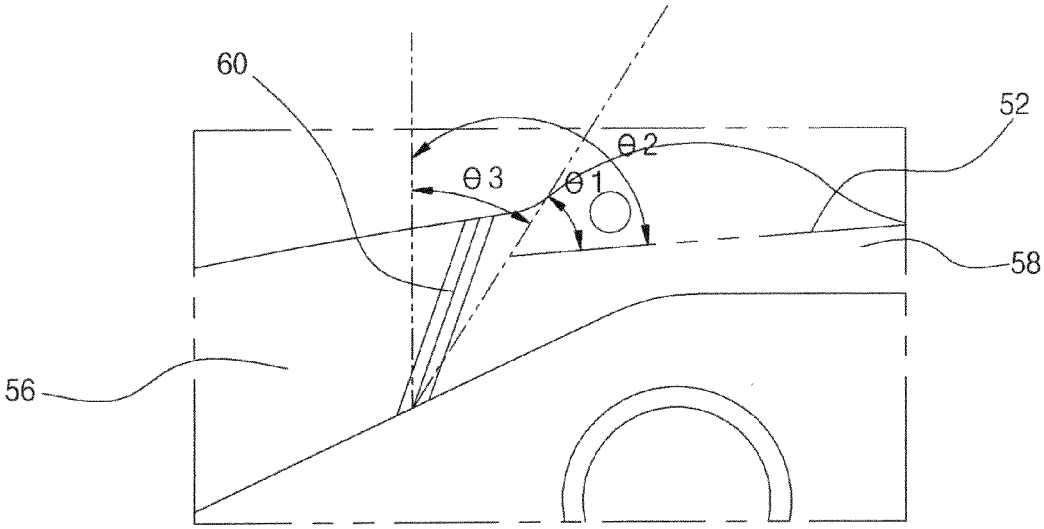
FIG. 5 is an enlarged view of a welded joint portion shown in FIG. 4.

As shown in FIGS. 4, 6, and 8, the outer surface of the welded joint portion 60 between the upper plate 56 and the extended member 58 is flush with the outer surface of the upper plate 56 and the outer surface of the extended member 58.

Figure 1:
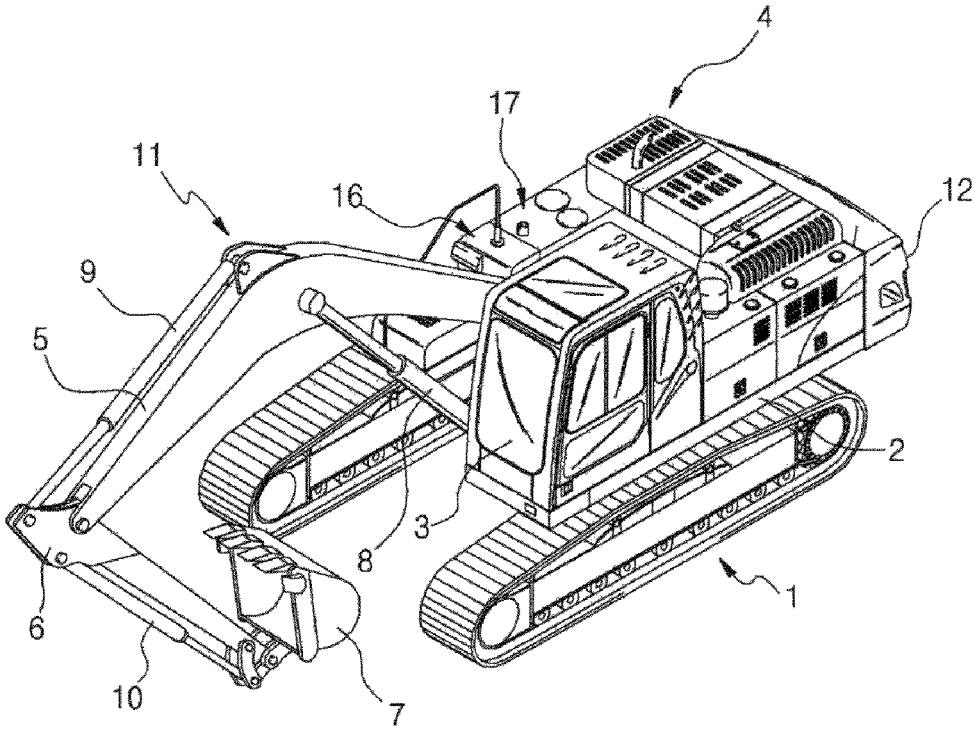
Fig. 1 Prior Art
FIG. 1 is a perspective view of a conventional tracked excavator.
Figure 2:
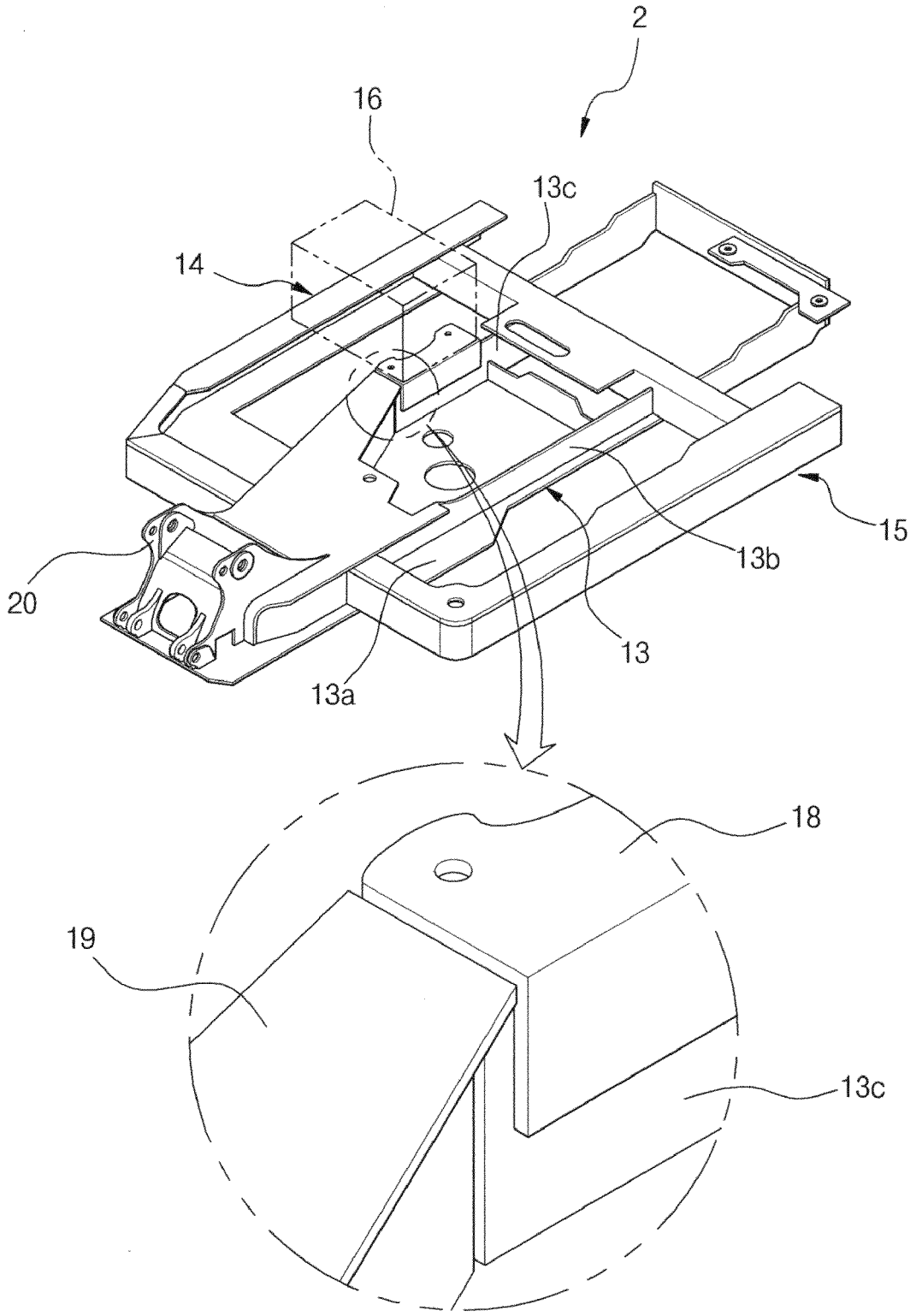
Fig. 2 Prior Art
FIG. 2 is a perspective view illustrating an upper frame of a conventional tracked excavator.

In this instance, the construction of the upper frame comprising the center frame 53, the left side frame 54 and the right side frame 55 is substantially identical to that shown in FIG. 2, and thus the detained description thereof will now be omitted.

The upper frame of the excavator according to this embodiment of the present invention will now be described with reference to the accompanying drawings.

As shown in FIGS. 3 and 6, after the center frame 53, the left side frame 54 and the right side frame 55 are separately manufactured in accordance with its design standards, the left side frame 54 and the right side frame 55 are respectively welded to the side plates 51 and 52 of the center frame 53.

In this instance, the extended member 58 secured to the side plate 51 of the center frame 53 and the right side frame 55, on which the fuel tank 57 is mounted, is welded to the upper plate 56 (see FIGS. 4 to 8), or the extended member 58 and the upper plate 56 are integrally manufactured as a single member (see FIG. 3).

Therefore, since the shock and load is transmitted from the working device (e.g., the boom) to the upper frame through the bracket 61 and the upper plate 56 during the lifting operation, it is possible to minimize the stress to be concentrated on a specific portion of the upper frame.

By the extended member 58 integrally extended from one end of the upper plate 56, in which the outer surface of the extended member 58 is flush with the outer surface of the upper plate 56 to ensure a cross section, the shock and the load is transmitted from the upper plate 56 to the upper frame through the extended member 58 during the operation, thereby preventing the stress from being concentrated on the upper frame.

As described above, in the process of transmitting the shock and the load to the upper frame from the working device when the excavator is operated, the shock and load is smoothly transmitted to the upper frame through the upper plate 56 and the extended member 58 which is integrally extended from the upper plate 56. Thus, it is possible to minimize the stress to be concentrated on the upper frame, thereby preventing the welded structure (e.g., the upper frame comprising the center frame 53, the left side frame 54 and the right side frame 55) from being damaged due to the stress or deterioration of the durability of the welded structure.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An upper frame of an excavator comprising:

a center frame having a bottom plate and a pair of side plates vertically welded to the bottom plate;

a left side frame welded to the side plate of the center frame;

a right side frame welded to the side plate of the center frame;

an upper plate placed in the front of the center frame for supporting a bracket for a working device, to which a boom is pivotally secured; and an extended member integrally extended from one end of the upper plate for supporting desired parts, wherein the extended member and the upper plate are jointed to each other by welding, a welded joint portion formed between the extended member and the upper plate has an inclined angle of 50 to 80 degrees relative to the horizontal direction of the center frame with respect to the side plate; and an outer surface of the welded joint portion between the upper plate and the extended member is flush with an outer surface of the upper plate and an outer surface of the extended member.

2. The upper frame as claimed in claim 1, wherein the extended member and the upper plate are provided in an integral member.

3. The upper frame as claimed in claim 1, wherein in a welded joint portion between the upper plate and the extended member, if the upper plate has a thickness (t1) relatively greater than a thickness (t2) of the extended member (t1>t2), an inclined portion is formed on the welded joint portion towards the upper plate.

* * * * *